United States Patent [19]

Wölfinger et al.

[11] 4,014,233

[45] Mar. 29, 1977

[54] APPARATUS FOR SEVERING A SHEET OF MATERIAL FROM A WEB

[75] Inventors: Arthur Wölfinger, Wiesbaden; Klaus Nicolay, Massenheim, both of Germany

[73] Assignee: Hoechst Aktiengesellschaft, Germany

[22] Filed: Mar. 19, 1976

[21] Appl. No.: 668,621

[30] Foreign Application Priority Data

Mar. 21, 1975 Germany ..... 2512540

[52] U.S. Cl. ..... 83/156; 83/175; 83/272; 83/424

[51] Int. Cl.[2] ..... B26D 7/14

[58] Field of Search ..... 83/175, 272, 269, 424, 83/156

[56] References Cited

UNITED STATES PATENTS

| | | | |
|---|---|---|---|
| 3,552,249 | 1/1971 | Ballard et al. | 83/424 X |
| 3,665,796 | 5/1972 | Witte | 83/175 X |

*Primary Examiner*—Willie G. Abercrombie
*Attorney, Agent, or Firm*—James E. Bryan

[57] ABSTRACT

This invention relates to an improvement in an apparatus for cutting a sheet from a web of material, including a magazine roll for the web of material, a cutting station, at least one feeding device for the web upstream of the cutting station and which is stationary during a cutting operation, a feeding device downstream of the cutting station and which is in operation during a cutting operation, movable curved guide means between the cutting station and the downstream feeding device, which guide means provides a shorter path for the web of material between the cutting station and the feeding device downstream thereof during the cutting operation, the improvement comprising separate drive means for the movable curved guide means, additional feeding means for the web including at least one rotary element means positioned between the cutting station and the movable guide means, said rotary element means being adapted to rest against a web of material with a frictional force lower than that of the other feeding devices, and means adapted to drive said rotary element means at a circumferential speed exceeding the speed of the web of material.

7 Claims, 4 Drawing Figures

APPARATUS FOR SEVERING A SHEET OF MATERIAL FROM A WEB

Figure 1:
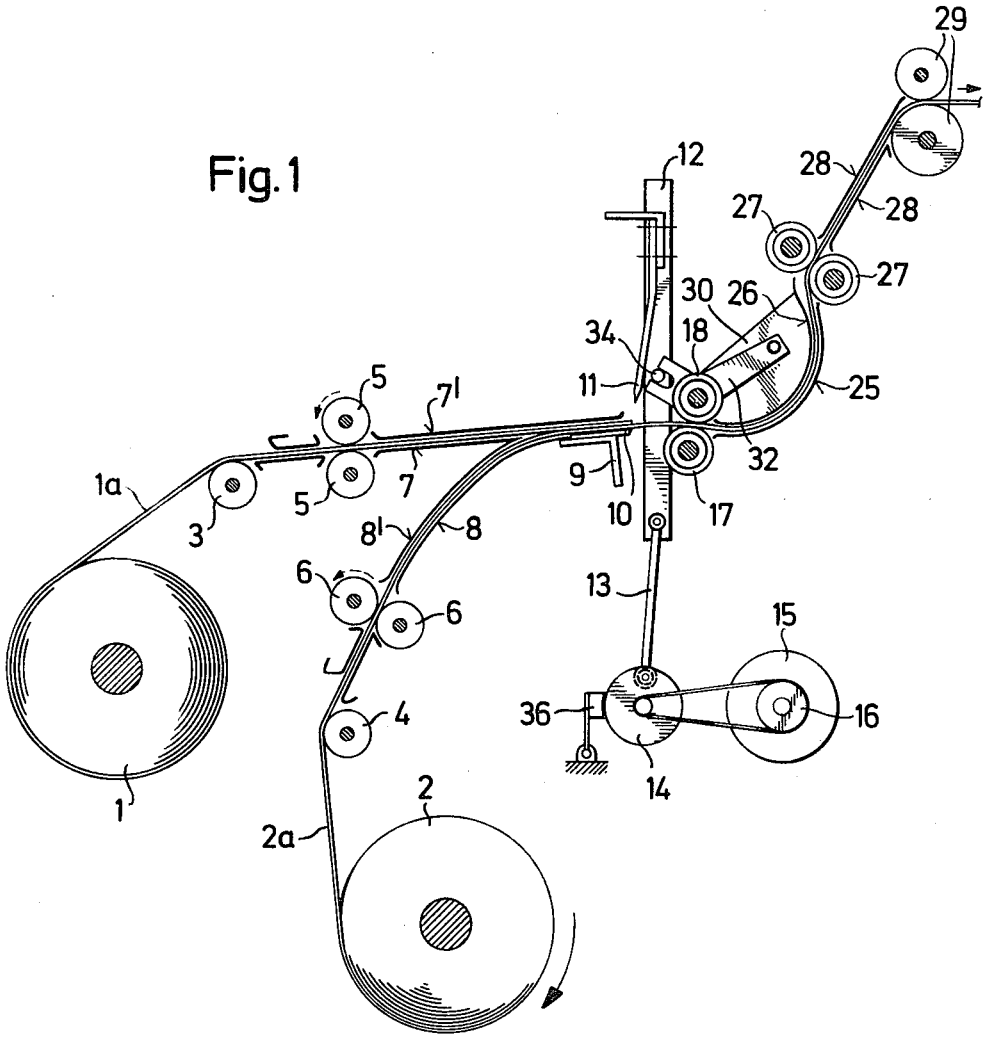

This invention relates to an apparatus for severing a sheet of material from a web, in particular for severing a sheet of copying material in accordance with the size of an original, according to German Pat. No. 2,044,820, the apparatus comprising at least one magazine roll for the web of material, a cutting station, at least one feeding device which is arranged upstream of the cutting station and is held stationary during the cutting operation, a feeding device downstream of the cutting station which is in operation during the cutting operation, and, arranged between the cutting station and the downstream feeding device, a moving, curved guide means which provides a shorter path for the web of material between the cutting station and the feeding device downstream thereof during the cut.

In a known device of this type, the cutting station comprises an upper blade which is movable with respect to the lower blade and is connected with and driven by an eccentric shaft to cut a web of material reeled from a magazine roll. The web of material is conveyed by a pair of feed rollers which represent the feeding device upstream of the cutting station - when viewed in the direction of feed - and, as the second feeding device, a pair of transport rollers arranged downstream of the cutting station. Between the cutting station and the second feeding device, the path of the web of material is guided between a lower, curved guide plate and an upper guide means of similar curvature. After leaving the second feeding device, the web of material, which may be by then combined with an original, is conducted to the exposure station of a photoprinting apparatus, for example.

This known apparatus is distinguished in that the curved guide means is capable of displacement, so that it can move to and fro in the direction of the guide plate. If the web of material is held stationary by the feeding device upstream of the cutting station, for the execution of the cut, while the downstream feeding device continues to transport the web of material, the path of the web between the cutting station and the downstream feeding device is shortened and the web of material pushes the curved guide means from the guide plate. At the same time, the web of material is tautened in a desirable manner within the cutting zone by the weight of the curved guide means, thus allowing a clean and smooth cut without creating undue tension in the material within the other zones of the web. After the web of material has been cut, the curved guide means drops back upon the guide plate so that a curved, closed guide channel is again formed.

It was found that this apparatus permits a clean cut of the web of material without tearing it, but that irregularities in the accuracy of the cut may occur, especially when webs of different widths are used and different feed speeds are selected. These irregularities are due to the fact that during lifting of the moving guide means, forces due to gravity act upon the web of material which become effective as a drag componenet in the web of material and act upon the two pairs of feed rollers, thus causing the web of material to be pulled through the rollers in a manner defying control. Prior to the cutting operation, the section of the web extending between the cutting station and the feeding device upstream thereof is pulled forward by an undefined length, so that greater tolerances for the cutting zone become necessary. Also, the portion of the web which is being transported to the original by the feeding device downstream of the cutting station is pulled back, so that during the following copying operation this section of the material will not be as accurately in register with the original as would be desirable.

Even more serious irregularities may occur if a second pair of driven rollers provided downstream of the pair of transport rollers downstream of the cutting station, for example a pair of entry rollers to the exposure station, is arranged in such a manner that different lengths of the web are seized either by only one or by both pairs of feed rollers. If both pairs of feed rollers engage a relatively long section of the web, a relatively long section of the web is pulled through the feed rollers of the feeding device upstream of the cutting station when the curved guide means is lifted. If, on the other hand, a shorter section of material is held by only one pair of transport rollers downstream of the cutting station, the web of material is pulled back more effectively from the pair of transport rollers and a shorter section of material is pulled through the pair of feed rollers arranged upstream of the cutting station.

Another cutting device, which is also part of the prior art (German Utility Pat. No. 71 07 020) is also not altogether free from these deficiencies. In this apparatus, a shorter way for the web of material between a cutting station and a feeding device downstream thereof is produced by an arched guide plate capable of being swivelled downwardly against the action of a spring when the web of material is tautened. However, this swivelling process also must overcome not only the force exerted by the spring, but also the force of inertia or gravity of the swivelling guide plate and other components connected with this guide plate.

It is the object of the present invention to improve the construction disclosed in the above German patent in such a manner that it is possible not only to produce clean cuts without undue stress on the material, but that the cuts are also made in the desired location, with a high degree of accuracy. Moreover, the width of the web of material and its feed speed should have no effect upon the position of the cut, if possible.

This object is achieved by the present invention, which represents an improvement of the invention disclosed in the above-mentioned German patent.

In this embodiment, also, the movable curved guide means provides a shorter path for the web between the cutting station and the feeding device arranged downstream of the cutting station, the path being shortened when the feeding device upstream of the cutting station is stopped for the cut, whereas the feeding device downstream of the cutting station continues its feeding operation. In this case, however, the material may enter the area of the moving guide means without being exposed to forces exerted by the guide means, because, driven by a separate drive, the curved, upper guide means is tilted away before the web of material begins entering its area. In this manner, the web of material is not exposed to any additional tension tending to accelerate the advance of the web in the zone of the stationary feeding device upstream of the cutting station and to retard it in the zone of the feeding device downstream of the cutting station. Nevertheless, the necessary tautening of the material in the area of the cut is guaranteed, viz. by the additional feeding device provided between the cutting station and the moving guide means. This additional feeding device comprises a rotating element which lies against the material and rotates at a circumferential speed exceeding the feed speed of the material, so that it exerts an additional feeding force upon the web of material which is practically the only constant force acting upon the web of material in the zone of the cut and in the zone of the feeding device upstream of the cutting station when the upper guide means is lifted. In the zone of the feeding device downstream of the cutting station and downstream of the moving guide means, this additional feeding force has no effect. The friction between the web of material and the rotating element of the additional feeding device is so small relatively, that, although the web of material is tautened by the additional feeding device for the cut, the transportation of the web is still controlled by the feeding devices upstream and downstream of the cutting station. The relation between the feeding forces of these feeding devices and the additional feeding device is determined accordingly, by selecting suitable dimensions for the driving surfaces in contact with the web of material and suitable pairs of materials for contacting surfaces. Preferably, one pair of feed rollers of the feeding device downstream of the cutting station are rubber-coated in order to produce high frictional forces and the rollers are in contact with the web over the entire width thereof. The characteristic features of a particularly advantageous embodiment of a pair of rollers of the additional feeding device will be described below.

Although, according to the present invention, the rotating element of the additional feeding device is driven at a higher speed than the other feeding devices, it is not necessary to reset this speed prior to, during, or after the cutting operation, so that it suffices to provide, for example, a simple transmission gear between the rotating element and the driving element. Thus, the apparatus can be constructed with relatively simple means, despite the separately driven moving guide means and the additional feeding device. Above all, there is no need for a complicated differential gear.

The additional feeding device having the features described above not only serves the purpose of uniformly tensioning the web of material between the feeding device upstream of the cutting station and the cutting station, so that a perpendicular, exact cut is produced with material of any width and at different feed speeds, but it has the further advantage that the distance over which the material is conducted between the feeding device upstream of the cutting station and the curved guide means becomes considerably shorter. In this manner, the risk of the paper web piling up is substantially reduced.

Immediately after the cut, the moving guide means returns to its initial position. This movement of the moving guide means may be caused by gravity; a separate force, such as the one used for providing the shorter path, is not necessary for this purpose, but may be of advantage in some cases. Thereafter, the curved upper guide means and the lower guide plate again form a closed, curved path for a loop of the web of material.

In an advantageous embodiment of the apparatus according to the invention, in which the cutting station comprises a separately driven element which may be moved for the cutting operation, the moving curved guide means is connected with the movable element of the cutting station. The movable element of the cutting device may be, in particular, a guiding element for the knife.

In this embodiment of the invention, the drive used for the cutting operation is also employed to move the curved guide means in the desired manner. In this manner, the operation of the guide means can be reliably synchronized with the motions and actions in the cutting station. Before the knife guiding element and the blade connected with it sever the web of material, the curved guide means is removed from the web of material by the starting movement of the knife guiding element, thus enabling the loop formed by the guide means to straighten out when - likewise prior to the beginning of the cutting operation - the feeding device arranged upstream of the cutting station is stopped while the feeding device downstream of the cutting station continues its feeding operation. During the cutting operation, the moving curved guide means is maintained in its lifted position, away from the web of material. Immediately after the cutting operation, the knife guiding element and the moving guide means are returned to their initial positions, so that a new loop may be directly formed for the next cutting operation. The drive operating the cutting station and the moving guide means connected therewith is advantageously an electric motor which is connected with a movable element of the cutting station through a clutch and an eccentric shaft.

Further, the apparatus according to the invention having an upper curved guide means movable with respect to a lower curved guide plate is advantageously so designed that the curved guide means is tiltable, the guide means is in the form of a trough and has at least one side wall, and to at least one of the side walls a fork arm is attached which engages a knife guiding element in the cutting station which, in turn, is connected with the upper blade. In this embodiment of the invention, the reciprocating movement of the knife guiding element is converted, by means of inexpensive structural elements, into a swivelling motion of the moving upper guide means. For this purpose, the fork arm advantageously may be attached to the trough-shaped guide means in such a manner that the web of material leaves the gap between the moving upper guide means and the lower guide plate in the desired straight direction.

Advantageously, the apparatus according to the invention is so constructed that the additional feeding device comprises a driven feed roller beneath the web and a series of auxiliary rollers spaced from each other by distance pieces which loosely sit on a shaft and rest against the web of material by their own weight only.

The weight and dimensions of the auxiliary rollers resting loosely against the web of material are so selected that, in combination with the material of the web and the material selected for the feed rollers, the desired tension is created in the section of material between the additional feeding device and the feeding device arranged upstream of the cutting station. The outer diameters of the distance pieces are slightly smaller than those of the auxiliary rollers, so that the distance pieces are not normally in contact with the web of material. This arrangement guarantees that the section of the web extending between the feeding device upstream of the cutting station and the blades of the cutting station always has the same length, without exerting undue stress upon the web.

According to a further, inexpensive embodiment of the apparatus according to the invention, the trough-shaped moving guide means is mounted in a manner such that it may be tilted about the shaft on which the auxiliary rollers are loosely positioned. In this construction, a separate pivot for the moving guide means is unnecessary.

According to a particularly advantageous embodiment of the invention, the apparatus is so designed that the additional feeding device is arranged immediately downstream of the cutting station and the points in which the additional feed roller and the auxiliary rollers contact the web are slightly displaced from the plane comprising the upper surface of the lower blade, in a direction determined by the natural curvature of the web of material. This natural curvature causes the web of material to enter the gap between the feed roller and the auxiliary rollers in particularly reliable manner. Further, this arrangement guarantees that the web of material invariably rests upon the lower blade during the cutting operation, so that a smooth, perpendicular, accurate cut is achieved under all conditions. Since the feed roller and the auxiliary rollers are arranged immediately downstream of the cutting station, the section of the web of material in which the web is transported by the feeding device upstream of the cutting station is short. This also serves to prevent the material from accumulating.

Figure 1A:
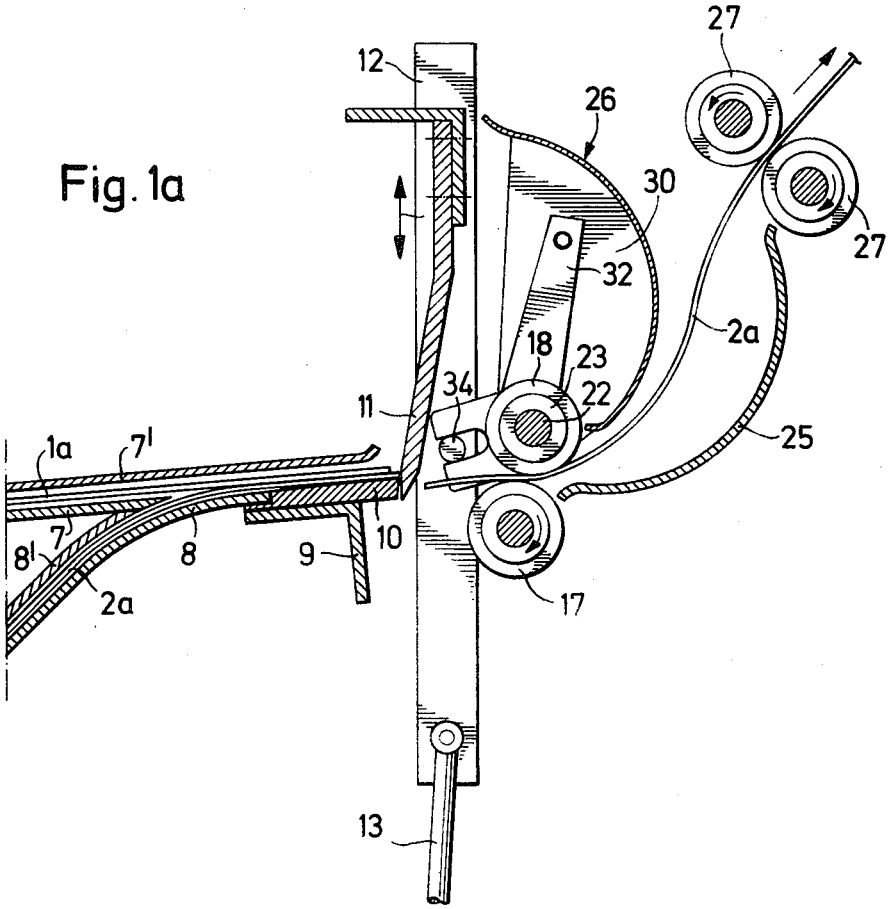
Figure 2:
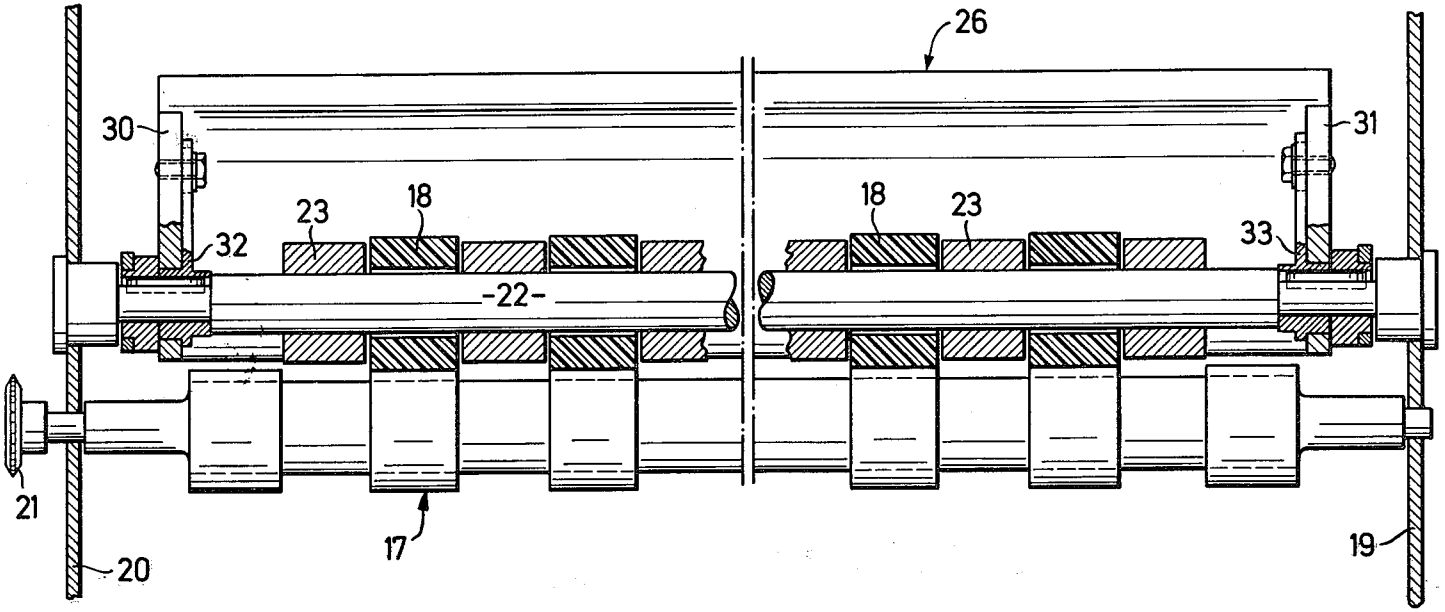
Figure 3:
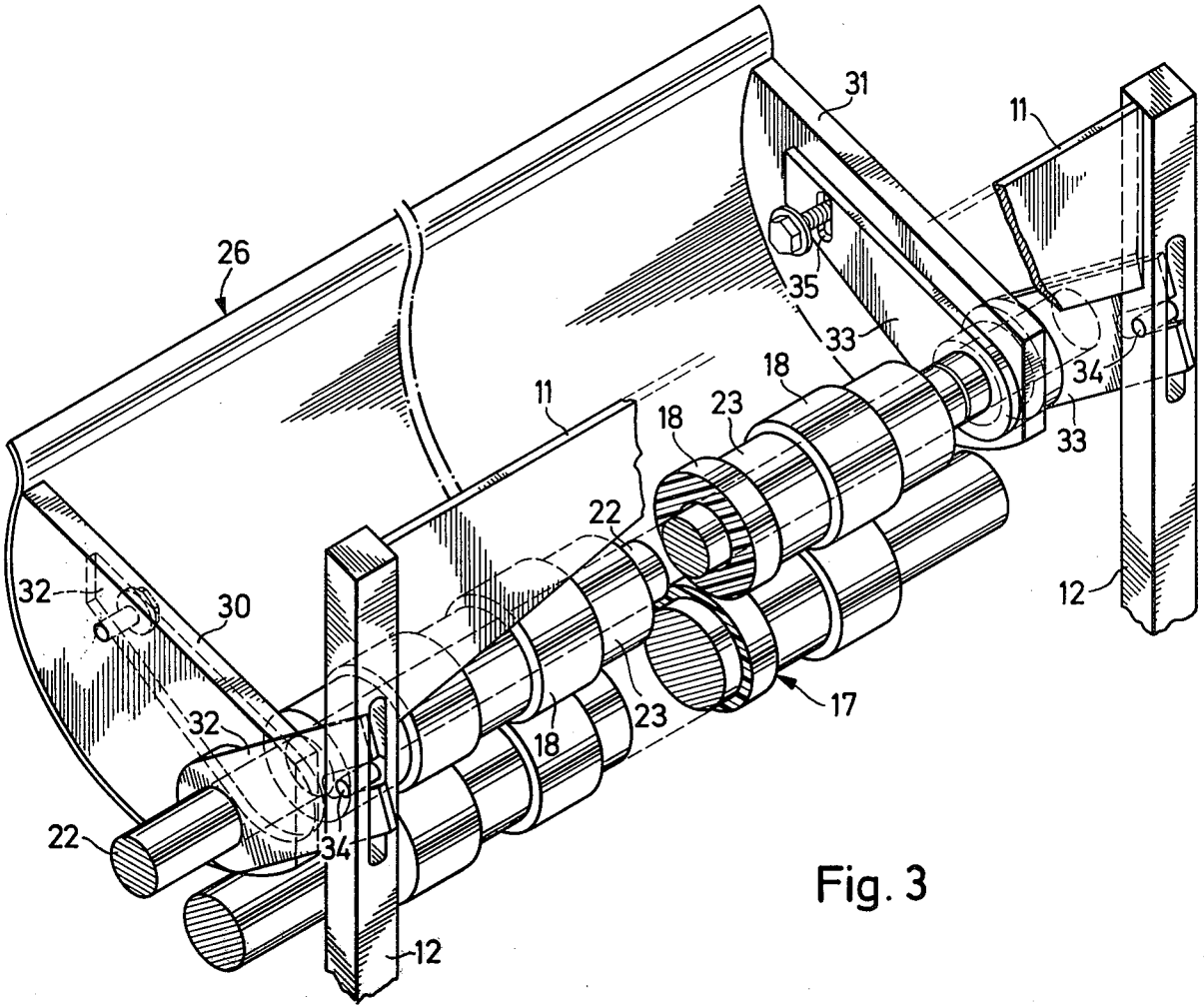

In the following, one embodiment of the invention will be explained with reference to the accompanying drawings in which:

FIG. 1 shows, in a diagrammatic side view, an apparatus for cutting one of two webs of material which may be part of a photoprinting machine, FIG. 1a shows, in section, an enlarged detail of FIG. 1 in a different working position, FIG. 2 shows a further detail, in a longitudinal section, especially the arrangement of the auxiliary rollers, and FIG. 3 shows a diagrammatic representation of essential components of the apparatus, especially the tiltable guide means.

The copying material is wound upon two magazine rolls 1 and 2. Two guide pulleys 3 and 4 and two pairs of draw-off rollers 5 and 6 serve, respectively, for drawing the webs 1*a* and 2*a* from the rolls 1 and 2. The draw-off rollers, which are in connection with a driving mechanism (not shown in the drawing) represent the first or upstream feeding device for the web of copying material. After leaving the draw-off rollers, the web of material passes between paper guides 8 and 8' or 7 and 7', respectively, and reaches the cutting station. The cutting station comprises a lower blade 10, which is mounted on an angle bracket 9, and an upper blade 11 coacting with the lower blade. The upper blade is attached to a knife guiding element 12.

The knife guiding element 12 is in connection with a connecting rod 13 of an eccentric drive 14 which is driven by an electric motor 15 through a clutch 16. The eccentric drive 14 may be stopped by a brake 36.

Immediately downstream of the cutting station there is arranged an additional feeding device comprising auxiliary rollers 18 resting loosely upon a feed roller 17. The feed roller 17 and the auxiliary rollers 18 are arranged in such a manner that their points of contact are a few millimeters, preferably 4 millimeters, below the upper edge of the lower blade, more exactly below the plane of the upper surface of the lower blade.

Details of the additional feeding device can be seen from FIG. 2. The feed roller 17 is rotatably mounted in the wall plates 19 and 20 of the housing. It is driven by a driving mechanism (not shown in the drawing) through a sprocket wheel 21. Above the feed roller 17, a shaft 22 is mounted in the plates 19 and 20 and on the shaft the auxiliary rollers 18 separated by distance pieces are arranged in such a manner that they are radially loose (bore clearance). Thus, the auxiliary rollers rest against the feed roller 17, or, in case a web of material has been inserted into the additional feeding device, on the web of material.

A curved guide plate 25 and a trough-shaped upper guide means 26 of similar curvature follow next in the direction of feed of the web of copying material. The guide plate 25 and the upper guide means 26 direct the web of material to a feeding device composed of a pair of transport rollers 27. From there, the web of copying material, which in FIG. 1 is shown only up to the cutting station, is passed between the guide plates 28 and enters a pair of entry rollers 29 which are part of an exposure station, not shown in the drawing.

Details of the trough-shaped guide means 26 can be best seen from FIGS. 2 and 3. The trough-shaped guide means 26 has side walls 30 and 31, with fork arms 32 and 33 secured thereto by screws 35. The fork arms, more accurately two-armed levers one end of which is forked, and the guide means to which they are attached, may rotate together with their axis 22. The forked ends of the fork arms engage the bolts 34 fastened to the knife guiding element 12 of the upper blade.

In order to be able to adjust the trough-shaped upper guide means 26 relative to the curved guide plate 25, the fork arms are provided with slotted holes in the area where they are attached to the upper guide means 26.

In order to illustrate the operations when the web of material is cut, it is assumed that the copying material withdrawn either from magazine roll 1 or magazine roll 2 has been fed by the pair of draw-off rollers 5 or 6 through the upper blade 11 and the lower blade 10 to the additional feeding device composed of the feed roller 17 and the auxiliary rollers 18 and is passed from there between the upper guide means 26 and the curved guide plate 25 to the pair of transport rollers 27 which feed the web of copying material through the guide plates 28 to the pair of entry rollers 29.

During this normal transportation of a web of copying material through the apparatus, the upper blade 11 and the knife guiding element 12 associated therewith are in their lifted positions so that the moving guide means 26 is lowered down onto the curved guide plate 25, leaving a slot for the passage of the web of copying material. In this stage, the eccentric drive 14 is uncoupled from the continually driven electric motor 15 and is stopped by the brake 36.

In order to cut the web of copying material 1*a* or 2*a*, the pair of draw-off rollers 5 or 6 feeding the web is stopped, whereas the pair of feed rollers 27 downstream of the cutting station continue their feeding operation. At the same time, the brake 36 of the eccentric drive 14 is released and the eccentric drive is coupled to the electric motor 15 by the clutch 16. The upper blade 11 and the knife guiding element 12 are thus lowered onto the web of material. Simultaneously, the upper guide means 26 is swung upwardly by means of the fork arms 32 and 33 before the loop of copying material formed between the upper guide means 26 and the curved guide plate 25 has had a chance to become shorter. This shortening occurs only when the upper guide means opens the required path. Since the feed roller 17 rotates at a higher speed than the draw-off rollers 5 or 6 and thus slides on the web of copying material, the web is tautened between the feed roller 17 and the draw-off rollers and has predetermined constant tension. In this manner, the web of copying material rests on the upper edge of the lower blade 10 and on the lower paper guide 7 or 8 of the paper guide pairs in the section between the lower blade 10 and the draw-off rollers 5 or 6. When the web of copying material is thus held between the additional feed roller 17 and the draw-off rollers 5 or 6, the upper blade penetrates into the web and cuts it cleanly in the desired place, transversely to the web.

By further rotation of the eccentric drive 14, the upper blade and the knife guiding element 12 are pushed upwardly again, thus causing the upper guide means 26 to be lowered. The upper guide means 26 thus impinges upon the section of the web of material positioned between the additional feed roller 17 and the pair of transport rollers 27. However, since high frictional forces are created when the pair of transport rollers 27 rub against the web of copying material - the transport rollers 27 being covered with a rubber coating for this purpose - whereas the auxiliary rollers 18 rest loosely on the web of copying material by their own weight only, this section of the web of material is pulled from between the auxiliary rollers and the additional feed roller practically without influencing the position and the transport of the severed web of copying material over the pair of transport rollers.

As soon as the upper blade has reached its uppermost position, the clutch 16 is released and the eccentric drive 14 is stopped by the brake 36. Thus, normal positions of the cutting station and of the upper guide means 26 are restored for the leading edge of the severed web of copying material.

A further important advantage is the fact that the connection between the upper guide means 26 and the knife guiding element 12 by the fork arms work in two directions.

If an apparatus for cutting copying material is combined with a copying station, it normally conveys the copying material somewhat more slowly than the copying station, in order to prevent the material from piling up. In the case of longer webs, the copying material thus exhibits a tendency to lift the upper curved guide means from the lower guide plate and to shorten the loop formed in this section. This means that only part of the loop would be available when required, during the cutting operation. On the other hand, if the upper moving guide means 26 is connected by the fork arms 32 and 33 with the knife guiding element 12, which is arrested during normal transportation of the copying material, the upper guide means cannot be lifted by the web of material, and, when the upper guide means 26 is moved upwardly shortly before the cut, by the knife guiding element and the eccentric shaft driven by the electric motor, the full length of the loop is available for shortening.

It will be obvious to those skilled in the art that many modifications may be made within the scope of the present invention without departing from the spirit thereof, and the invention includes all such modifications.

What is claimed is:

1. In an apparatus for cutting a sheet from a web of material, including a magazine roll for the web of material, a cutting station, at least one feeding device for the web upstream of the cutting station and which is stationary during a cutting operation, a feeding device downstream of the cutting station and which is in operation during a cutting operation, movable curved guide means between the cutting station and the downstream feeding device, which guide means provides a shorter path for the web of material between the cutting station and the feeding device downstream thereof during the cutting operation, the improvement comprising separate drive means for the movable curved guide means, additional feeding means for the web including at least one rotary element means positioned between the cutting station and the movable guide means, said rotary element means being adapted to rest against a web of material with a frictional force lower than that of the other feeding devices, and means adapted to drive said rotary element means at a circumferential speed exceeding the speed of the web of material.

2. An apparatus according to claim 1 in which the cutting station includes separately driven means adapted to move for a cutting operation, and means connecting said movable curved guide means with said separately driven means.

3. An apparatus according to claim 2 including curved upper guide means adapted to be moved with respect to a lower curved guide plate means, said upper guide means being tiltable and forming a trough having at least one side wall, and fork arm means on said side wall in engagement with knife guiding element means.

4. An apparatus according to claim 1 in which said additional feeding means includes a driven feed roller means adapted to be positioned below the web of material, and a series of auxiliary roller means spaced from each other by distance elements, said auxiliary roller means being loosely mounted, with play, on a shaft and being adapted to rest against the web of material by their own weight only.

5. An apparatus according to claim 4 in which the movable curved guide means is rotatable about the shaft on which said auxiliary roller means are loosely mounted.

6. An apparatus according to claim 4 in which said additional feeding means is positioned immediately downstream of said cutting station, and points at which the driven feed roller means and the auxiliary roller means contact the web of material are slightly displaced, in a direction determined by the natural curvature of the web of material wound from the magazine roll, from a plane including an upper surface of a lower blade.

7. An apparatus according to claim 1 including means whereby the movable curved guide means can be stopped.

* * * * *